US006730893B1

(12) United States Patent
Runde

(10) Patent No.: US 6,730,893 B1
(45) Date of Patent: May 4, 2004

(54) INDUCTION HEATING APPARATUS

(75) Inventor: Magne Eystein Runde, Trondheim (NO)

(73) Assignee: Sintef Energiforskning AS, Trondheim (NO)

( * ) Notice: Subject to any disclaimer, the term of this patent is extended or adjusted under 35 U.S.C. 154(b) by 0 days.

(21) Appl. No.: 10/129,924

(22) PCT Filed: Nov. 8, 2000

(86) PCT No.: PCT/NO00/00376

§ 371 (c)(1),
(2), (4) Date: May 13, 2002

(87) PCT Pub. No.: WO01/35702

PCT Pub. Date: May 17, 2001

(30) Foreign Application Priority Data

Nov. 11, 1999 (NO) ..... 19995504

(51) Int. Cl.[7] ..... H05B 6/10
(52) U.S. Cl. ..... 219/635; 219/677
(58) Field of Search ..... 219/635, 672, 219/677, 660; 373/152; 335/216, 299, 217, 301; 361/141, 19; 505/211, 431, 232

(56) References Cited

U.S. PATENT DOCUMENTS 4,082,936 A * 4/1978 Aoki et al. ..... 219/652
4,940,870 A * 7/1990 Shibata et al. ..... 219/634
4,990,878 A 2/1991 Takechi et al.
5,391,863 A 2/1995 Schmidt
5,546,261 A * 8/1996 Yoshida et al. ..... 361/19
5,781,581 A 7/1998 Fishman et al.

FOREIGN PATENT DOCUMENTS

JP 07031053 A * 1/1995 ..... H02H/9/02
JP 08031671 A * 2/1996 ..... H01F/36/00
WO 90/14742 11/1990

* cited by examiner

*Primary Examiner*—Quang T. Van
(74) *Attorney, Agent, or Firm*—Young & Thompson

(57) ABSTRACT

Apparatus for induction heating of billet-shaped blanks (10) of electrically well conductive and non-magnetic metal, in particular aluminum or copper, comprising a winding (21) adapted to surround the blank completely or partially, to be supplied with electric alternating current (8) and to be cooled (22) at least during the heating of the blank (10). The winding has turns comprising superconducting material and is enclosed by a thermally insulating chamber (33). The cooling (22) is adapted to maintain the winding at a temperature in the range 30–90° K, and the frequency of the alternating current (8) is adapted to be in the range of common mains frequencies.

13 Claims, 7 Drawing Sheets

INDUCTION HEATING APPARATUS

BACKGROUND OF THE INVENTION

This invention relates to an apparatus for induction heating of billet-shaped blanks of electrically well conductive and non-magnetic metal, in particular aluminium or copper, comprising a winding adapted to surround the blank completely or partially, to be supplied with electric alternating current from a power supply and to be cooled by means of a cooling system at least during the heating of the blank.

DESCRIPTION OF THE RELATED ART

A known and typical arrangement for such induction heating is shown in FIG. 1 in a simplified and schematic manner. There is shown a workpiece or blank 100 and a cut-through winding 101 which is adapted to be supplied with alternating current as shown. Moreover, with dashed lines there is illustrated at least partially how a generated magnetic field passes through the blank 100 for the heating thereof.

When the material in blanks of interest is an electrically well conductive and non-magnetic metal, such as aluminium and copper, the prior art induction heating devices have a low efficiency, namely a maximum of about 50%. In other words about one half of supplied electric power will get lost in the windings. Moreover induction heating of aluminium and copper blanks, including the so-called billets, is characterized by a high capacity per unit volume. In typical installations there is the question of capacities of 500 kW. Accordingly, within this field there is a strong desire of obtaining improvements for the purpose of energy economy and resource savings.

An additional factor of interest in this context is that the blanks concerned of aluminium or copper exist in the form of extrusion billets, which have a relatively elongate shape and are usually solid. Thus, these are per se with respect to their main shape, well suited for induction heating.

An actual example of induction heating may be found in U.S. Pat. No. 5,781,581. This primarily relates to a chamber ("soaking pit") for cooling and re-heating of parts having just been cast. In this case the material apparently is steel. The parts are placed in the chamber, which is adapted to be evacuated. There are mounted radiation screens or the like in order to prevent heat from escaping and getting lost. In the case of a need for re-heating, induction effect is employed, or as an alternative direct heating by providing for a current flow through the blank or workpiece. The frequency range in induction heating is stated to be in the range of 100–1000 Hz. These frequencies indicate that there is here the question of a magnetic material (steel) that is to be treated. In the patent specification and as a subordinate feature there is included a short reference to superconduction as a possible effect of interest.

Another example of prior art having a certain interest in this connection, is U.S. Pat. No. 5,391,863. Superconduction is not mentioned in this patent specification, that otherwise has a content corresponding to some degree to the first paragraph of the present description.

In this connection there is reason to note that superconductors have been known for a long time and also at least from more than 10 years ago based on cooling with liquid nitrogen. The present invention comprises an advantageous utilization of superconductors, as will appear from the following description.

In an arrangement for induction heating of solid, cylindrical billets as illustrated in FIG. 1, the efficiency is determined by the following formula:

$$\eta = \frac{1}{1 + \sqrt{\frac{\rho_v}{\rho_b \mu_b}}}$$

where $\rho_v$ and $\rho_b$ are the resistivities of the material in the winding and the blank or billet, respectively, and $\mu_b$ is the relative permeability of the billet material. Whereas the permeability of iron is of the order of magnitude of 1000, it is approximately equal to 1 for non-magnetic materials such as aluminium and copper. This means that iron is substantially more favourable with respect to the efficiency in such induction heating. When the blank or billet consists of a non-magnetic material with very good electrical conductivity, as for example aluminium or copper, the efficiency will be about 50%, since the resistivities for a traditional copper winding and the blank material respectively, are approximately equal. In other words the value of the root expression in the formula above, will be approximately equal to 1. Thus, one half of supplied electric power will be consumed in the induction winding and one half will be transferred to the blank.

SUMMARY OF THE INVENTION

Substantial improvements in the above relationships will be obtained according to the invention in an apparatus for induction heating as referred to at the beginning of this description, in that the winding has turns comprising superconducting material and is surrounded by a thermally insulated chamber, that the cooling system is adapted to keep the winding at a temperature in the range of 30–90° K, and that the frequency of the alternating current is adapted to be within the range of common mains frequencies.

In an advantageous embodiment of the apparatus according to the invention, the cooling in the cooling system takes place with liquid nitrogen or helium gas being brought to circulates in cavities or cooling channels adjacent to the winding inside the thermally insulated chamber. Nitrogen has a boiling point of 77° K at normal atmospheric pressure and in actual practice it can be appropriate to keep the winding temperature 10–12° lower than this boiling point, when liquid nitrogen is used. On the other hand there will often in practice be a somewhat higher temperature in the actual winding than the temperature of the cooling medium. When using nitrogen at 77° K the winding temperature therefore may be at 90° K. A winding temperature of 60° K will be optimal in many instances. Suitable temperatures in this connection will to a significant degree depend upon the materials employed in the winding, in particular the superconducting materials. When helium is used, the temperature range should be between 40° and 60° K. Below 40° K the cooling costs will be significantly increased.

In another possible embodiment there is according to the invention, provided a jacket of well heat conducting, but electrically insulating material being in thermal contact with the winding, and being cooled by means of a cooling unit which is a part of the cooling circuit of the cooling system.

The embodiments just referred to show that windings comprising superconductors require quite different design solutions from what is tranditionally found in electric induction heating. Usual structures with copper conductors involve hollow conductors, so that cooling water can circulate through the hollow conductors in the winding. With the low (cryogene) temperatures being of interest according to the invention, there will be the question of quite different solutions for the cooling. Accordingly, the thermal insulation will also be more significant. Moreover, it is a feature of interest that certain types of superconducting threads have anisotrope properties in so far as the losses depend upon the direction of the magnetic field in the winding.

A substantial advantage with respect to efficiency consists therein that this will increase from about 50% to 90–95%. This of course is very significant and shows that there is here the case of a new solution having a high practical value for the industry.

BRIEF DESCRIPTION OF THE DRAWINGS

In the following description the invention will be explained more closely with reference to the drawings, showing somewhat schematically and simplified various embodiments being possible in practice.

DESCRIPTION OF THE PREFERRED EMBODIMENT

Figure 2:
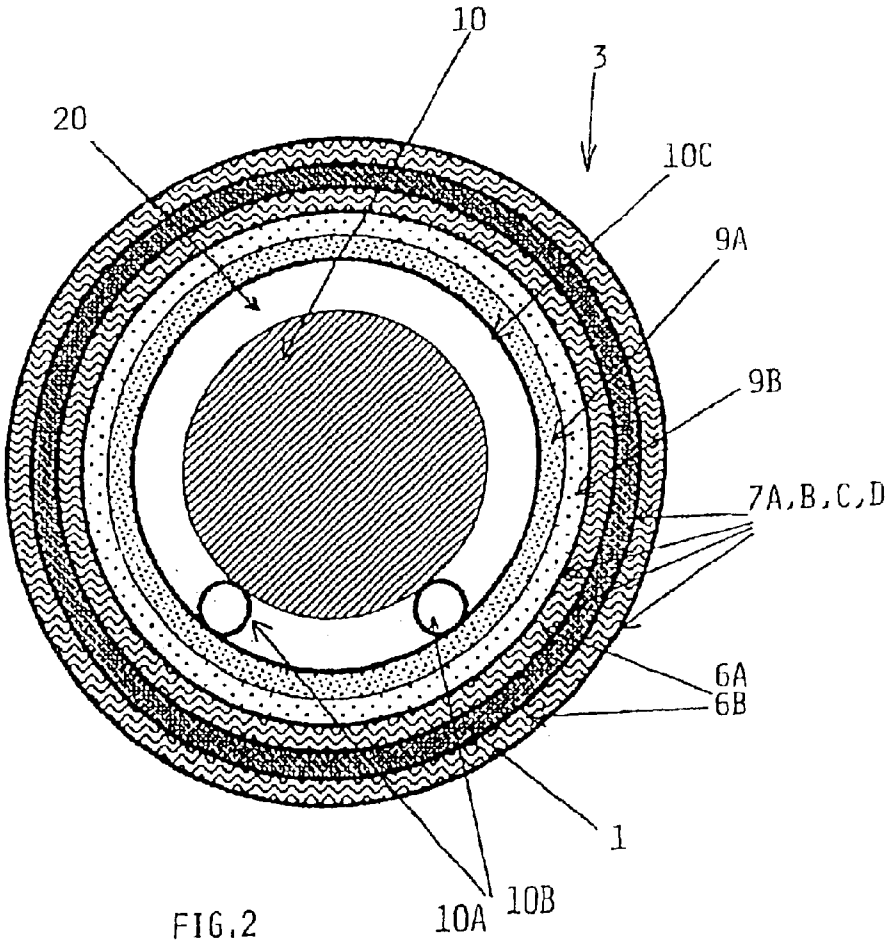
Figure 1:
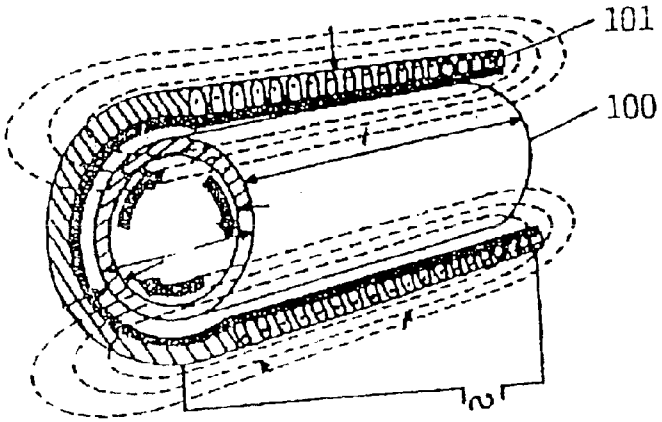
FIG.1 PRIOR ART
FIG. 1 shows (as already mentioned) a typical known arrangement for induction heating, FIG. 2 in cross sectional view shows the main features of an embodiment of the apparatus according to the invention, FIG. 3 in partial cross section similar to FIG. 2 shows somewhat more in detail some structural features of an apparatus according to the invention, FIG. 4 in partial axial section shows an embodiment corresponding to the one in FIG. 3.

Centrally in the apparatus of FIG. 2 there is inserted a workpiece or blank 10 to be heated by induction effect. The blank 10 is supported by two tube-shaped rails 10A and 10B which can be made of non-magnetic steel. Radially innermost the induction heater shown here, has a inner lining 10C of non-magnetic steel, so that there is formed an airgap 20 between the blank 10 and the surrounding induction heating apparatus. An essential element therein is an induction winding 1 which according to the invention comprises superconductors. Thus, the winding is surrounded by thermal insulation layers which together constitute a thermally insulated chamber 3. The composite wall that constitutes the chamber 3 lies between the above inner lining 10C and an outer, protective layer 7D of for example glass fiber reinforced epoxy material. In addition to the outer layer 7D corresponding layers 7A and 7C can cover the winding 1, and a layer 7B delimits an insulation layer 6B radially inwards. Advantageously the insulation 6A and the insulation 6B at the outside of the winding 1 can be so-called superinsulation consisting of several layers of metallized polymer foils in vacuum. Inside the superinsulation 6A there is a layer 9B of temperature resistant thermal insulation and then again inside this a layer 9A of refractory ceramics, typically in the form of aluminium silicate or the like.

It is obvious that the above examples of specific materials employed in the construction of the thermally insulated chamber 3, can be replaced by other materials having corresponding properties.

It is not shown in FIG. 2 how alternating current is supplied to winding 1, nor how the winding comprises superconducting ribbons in a bath of supercooled liquid nitrogen. This cooling serves to maintain the winding at a temperature in the range of 30–90° K, possibly limited to 40–77° K. The frequency of the alternating current applied, is adapted to be in the range of common mains frequencies.

For the required cooling of winding 1 to (cryogene) temperatures there are also alternatives to liquid nitrogen, namely in the first place helium gas. The cooling medium is brought to circulate in the form of a bath as mentioned, adjacent to the winding 1 within the thermally insulated chamber 3. During operation of such an apparatus the cooling normally in practice will be effected all the time, and not only during the actual heating of a blank. The cooling effect therefore will be more or less necessary all the time because there will continuously be present a certain, small leakage of heat into the apparatus from the surroundings.

Figure 5:
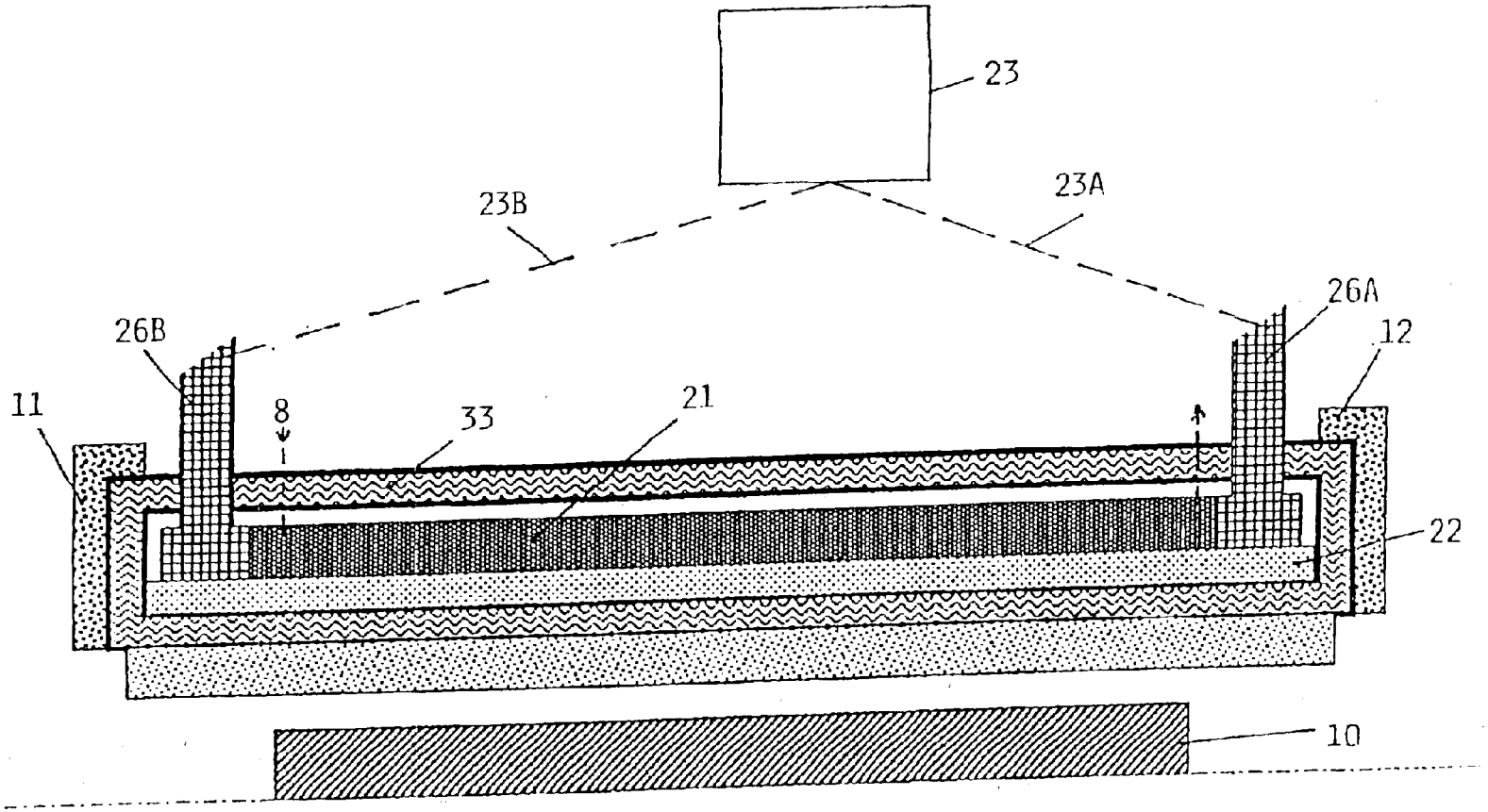
FIG. 5 shows the main features of another embodiment as a whole, and in axial cross section.

In the embodiment of the apparatus as a whole, as it is illustrated in FIG. 5 in axial cross section, elements as referred to above in connection with FIG. 2 are found again, i.e.: blank 10, a winding 21 and a surrounding chamber 33 for the thermal insulation of the winding. Supply of electric alternating current to winding 21 is indicated at 8, with a corresponding terminal at the other end of the winding.

Instead of circulating a bath of cooling fluid, such as liquid nitrogen or helium gas around the winding, the embodiment of FIG. 5 shows a jacket 22 of well heat conducting and electrically insulating material, which has a thermal contact with winding 21 and is thermally connected to a cooling unit 23. Thus, through a wall of chamber 33 there is inserted a rod-lik cooling head 26A and 26B, respectively, at either end of the winding, for conveying heat out from jacket 22.

Cooling heads 26A and 26B each has its fluid connection to cooling unit 23 as shown at 23A and 23B, respectively. Thus, it is appropriate that cooling heads 26A and 26B can contain channels or cavities with expansion valves incorporated in a cooling circuit together with unit 23. These cavities or channels in the cooling heads can be located in the parts thereof being outside chamber 33, or possibly in extensions of the cooling heads inside the chamber adjacent to jacket 22. With such an arrangement the winding 21, where the losses are generated, will be in good thermal contact with the heat conducting jacket 22, so that heat will be conducted outwards axially along this towards each of the ends. The losses are at a maximum adjacent to the ends of the winding, so that it is favourable with the position shown of the two cooling heads 26A and 26B. This will result in lower temperature gradients and thereby a more optimal operation.

As will appear from FIG. 5 it is an advantageous embodiment that jacket 22 is located substantially radially inside winding 21 and thereby can serve as a supporting element for the winding.

Figure 6:
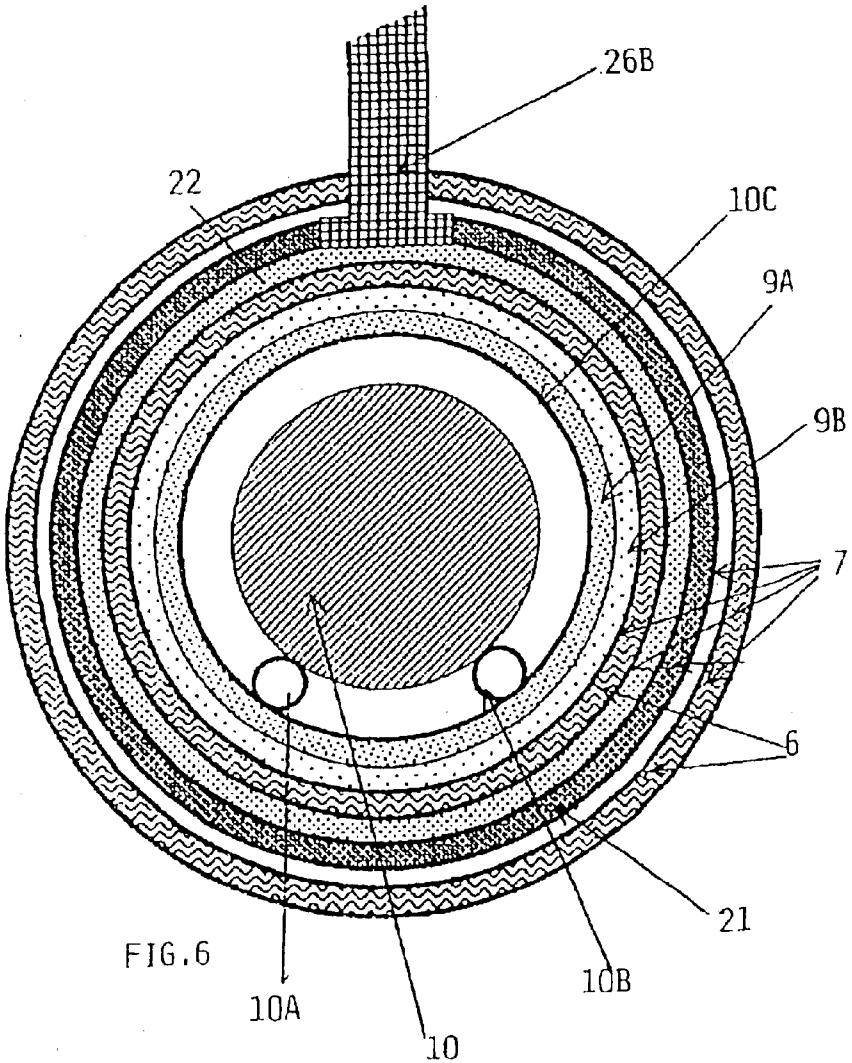
FIG. 6 shows in enlargement and more in detail a cross section of an apparatus as in FIG. 5.

FIG. 6 shows somewhat more in detail and in cross-sectional view the cooling method according to FIG. 5, i.e. jacket 22 inside winding 21 and with cooling head 26B. As in the embodiment of FIG. 2, blank 10 is also shown supported by rails 10A and 10B. The thermally insulated chamber 3 moreover comprises the essential layers in the structure, with superinsulation 6, glass fiber reinforced epoxy layer 7, temperature resistant insulation 9B and refractory cream 9A. Radially innermost against the cavity for blank 10, the structure as also in FIG. 2, is delimited by a steel lining 10C.

Figure 4:
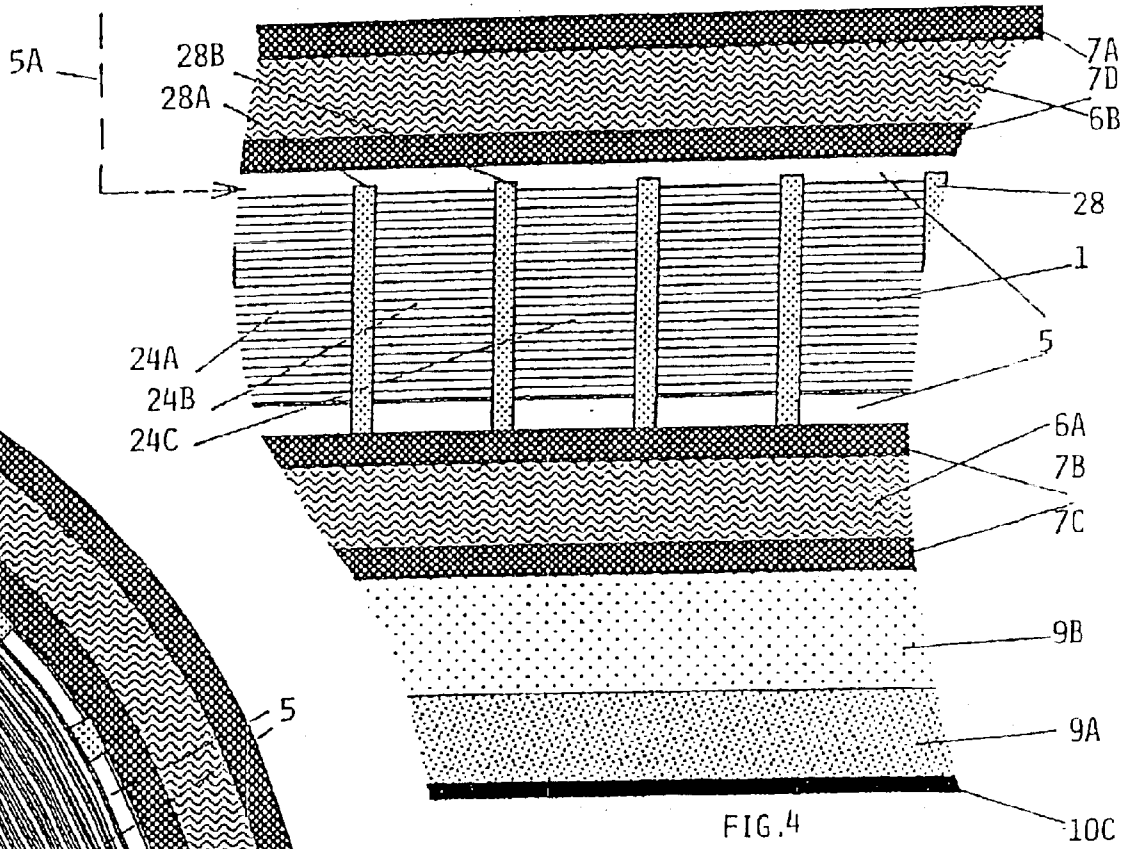
Figure 3:
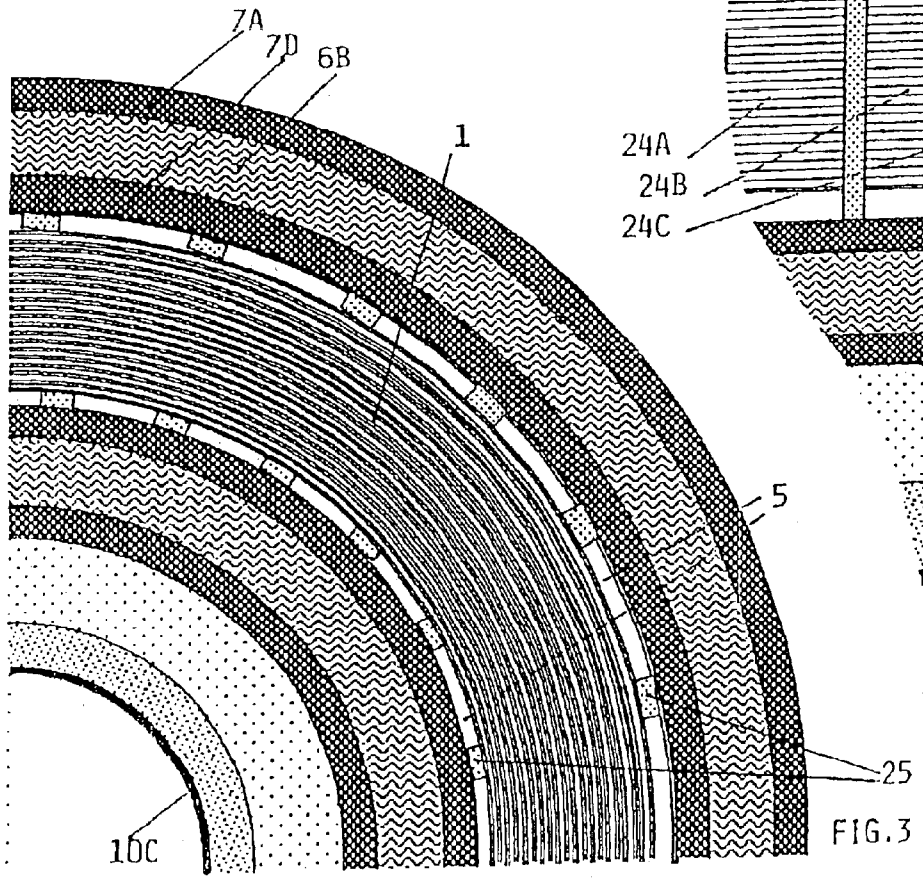
Figure 7:
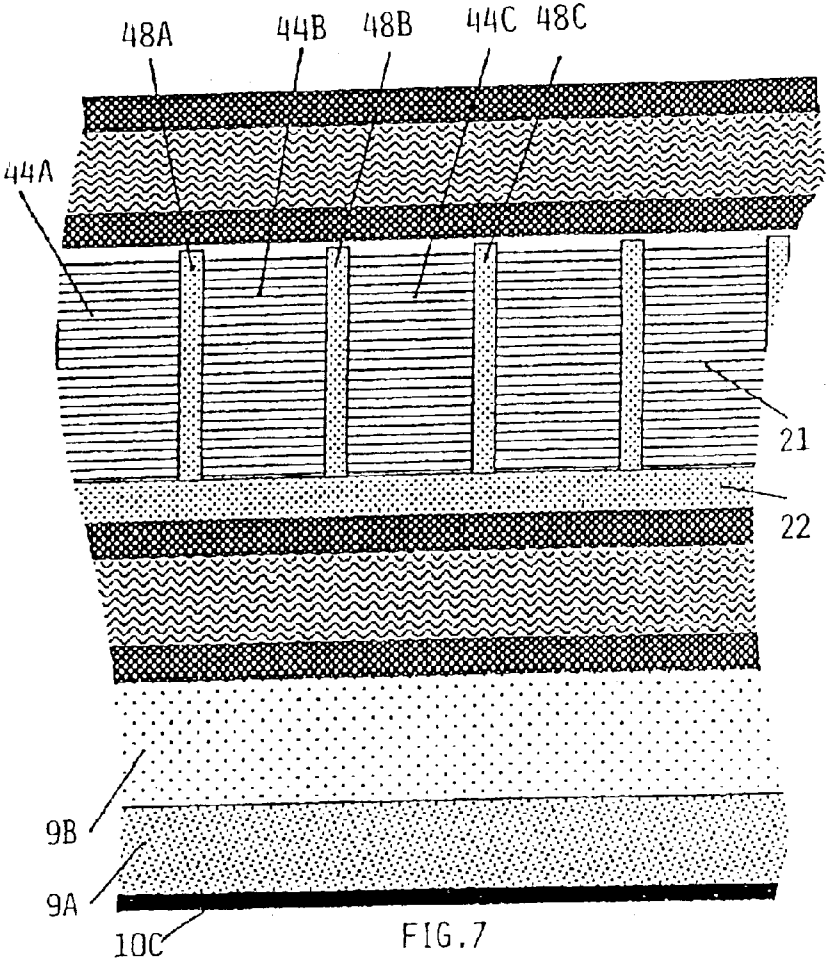
FIG. 7 shows a further enlarged and more detailed, partial axial cross section of an embodiment as in FIG. 5 and FIG. 6, FIG. 8 and FIG. 9 serve to illustrate a modification of the magnetic field at an end portion of an induction heating apparatus, FIG. 10 in cross sectional view shows an advantageous assembly of conductor elements into conductor groups being employed for the winding or windings in an induction heating apparatus, FIG. 11 schematically shows the construction of a complete winding in a layered manner according to a common method of winding, taking as a basis conductor groups consisting of conductor elements as for example shown in FIG. 10, and FIG. 12 schematically shows in a similar way how a complete winding can be built up in the form of "pancake" or package-like winding parts.

Still more in detail an embodiment in the principle as in FIGS. 5 and 6, is illustrated in a partial axial cross section in FIG. 7. Also therein there is found a lining 10C, cream layer 9A, insulation layer 9B and inside the thermally insulated chamber the winding 21 with its associated jacket 22. What is seen in particular from FIG. 7 is the fact that the winding is sub-divided into relatively flat, "pancake"-like packages or winding parts 44A,44B,44C and so forth. This structure of the winding with several flat winding parts will be discussed more closely below in particular with reference to FIG. 12. Between the flat, package-like winding parts 44A,B,C and so forth, there are shown heat conducting rods or discs 48A,48B,48C and so forth, preferably consisting of electrically insulating material. The heat conducting effect of these however, is very significant for keeping winding 21 cooled, and accordingly elements 48A,B,C must have a good heat conducting contact with jacket 22. Whereas the embodiments of FIGS. 5, 6 and 7 are based on heat removal from the insulated chamber 33 out through the walls thereof by means of cooling heads 26A,B, the embodiment of FIG. 2 as mentioned is based on circulation of a gaseous or liquid cooling medium around the winding. This also applies to FIGS. 3 and 4, showing in more detail embodiments being in the principle as the one in FIG. 2. This in part appears from the use of corresponding reference numerals. Regarding FIG. 4 it is specifically to be noted that winding 1 therein is sub-divided into flat, package-like parts 24A,24B,24C and so forth, corresponding to the sub-division as just explained above in connection with FIG. 7. Likewise in FIG. 4 there are shown intermediate rods or discs 28,28A,28B and so forth, between winding parts 24A,B,C, in a similar way as in the arrangement of FIG. 7. With a cooling medium such as liquid nitrogen introduced into the annular cavities 5 shown around winding 1, elements 28,28A,B thus will contribute to the cooling of all portions of the winding. The supply of cooling medium for the above circulation is schematically indicated in FIG. 4 at 5A. Accordingly there must be provided hoses or tubes penetrating chamber wall 7A-6B-7D for this cooling medium circulation.

In the cavities 5 according to FIG. 3 there are shown axially extending rods 25 for the same purpose and with material properties as elements 28,28A,B in FIG. 4. The material of these elements and the rods accordingly is electrically insulating, but thermally well conducting. Besides it has to be mechanically strong and robust. Suitable materials can for example be aluminium oxide or aluminium nitride.

Then reverting to FIG. 5 there is additionally shown means for modifying the magnetic field that is resulting from supply of alternating current at 8 to winding 21. More specifically there are shown at either end of the apparatus, elements 11 and 12 of a ferromagnetic material, which apparently will have an influence on the magnetic field. The influence consists therein that the magnetic field is extended more axially outwards at the ends of winding 21, so that these end portions to a lower degree will be subjected to radially directed magnetic field-components. In other words the influence can be considered to provide for a field extension in axial direction, which reduces the alternating current losses in the winding when this contains anisotrope superconductors.

Figure 8:
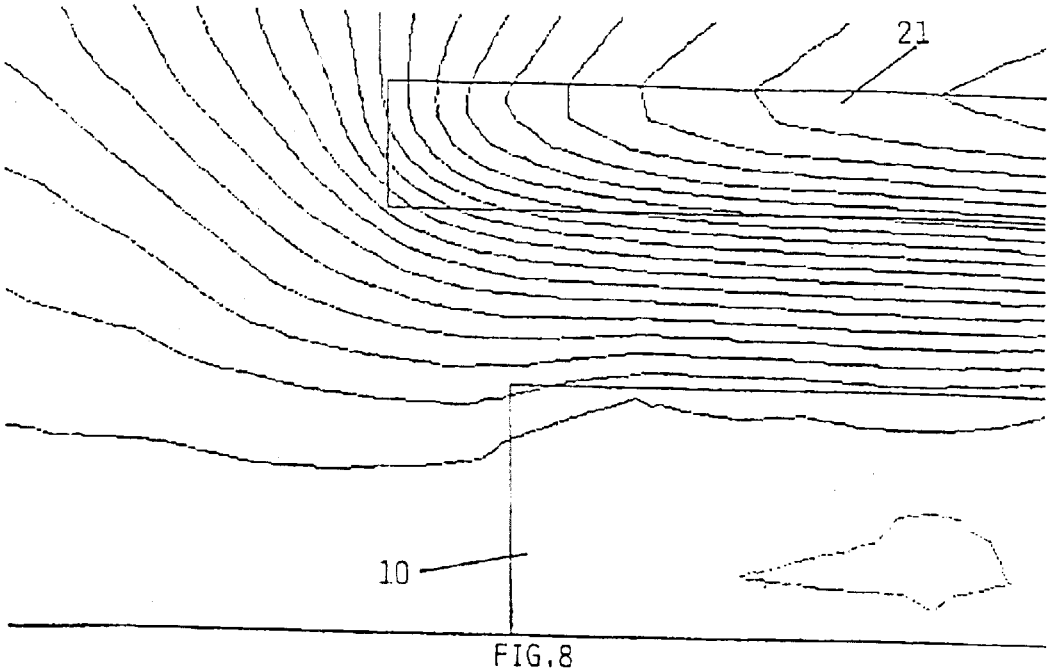
Figure 9:
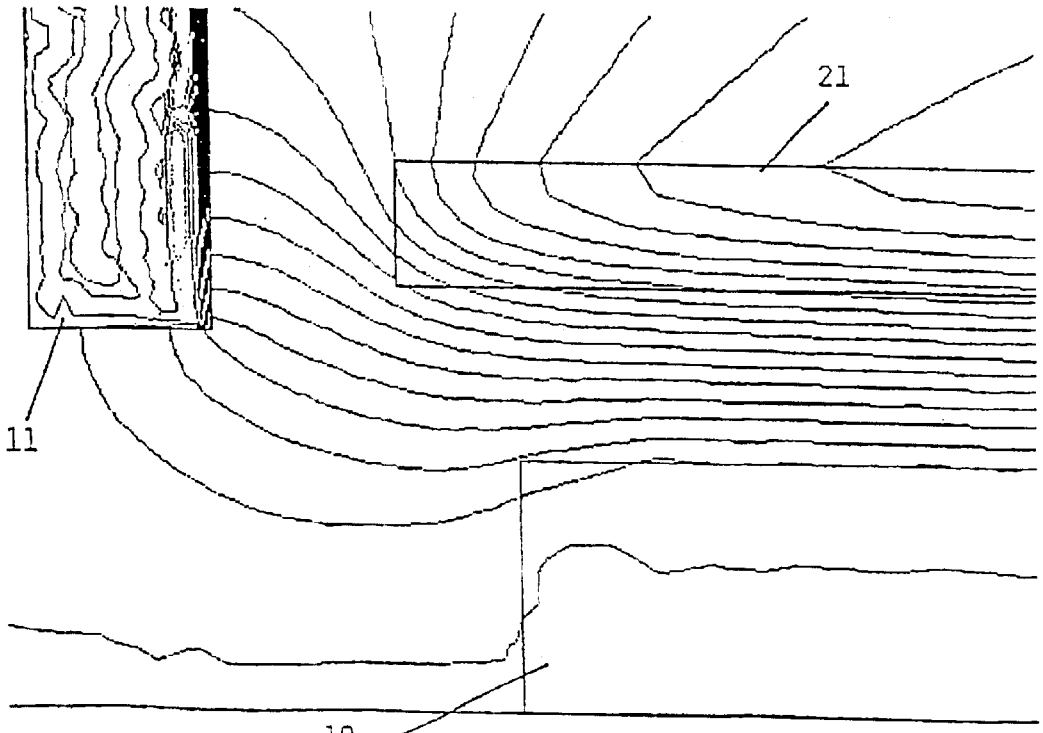

The effect of elements 11 and 12 as just explained above, is illustrated by means of the diagrams in FIG. 8 and FIG. 9, respectively. These figures show the end portion of a blank 10 and a corresponding end portion of winding 21. In FIG. 8 there has not been provided any means for modifying the magnetic field, whereas the element 11 is found in FIG. 9. It is seen from the magnetic field diagrams that the field lines in FIG. 9 are pulled appreciably more outwards axially from winding 21, so that this to a lesser degree is subjected to the radial field components, these being undesired. The diagrams of FIG. 8 and FIG. 9 are based on field calculations which cannot be regarded as optimized, but the effect is clear.

Instead of employing ferromagnetic materials as in elements 11 and 12 in FIG. 5, a corresponding influence on the magnetic field pattern at the ends of winding 21 can be obtained by appropriate variation of the winding structure, in particular at the end portions of the winding.

Figure 10:
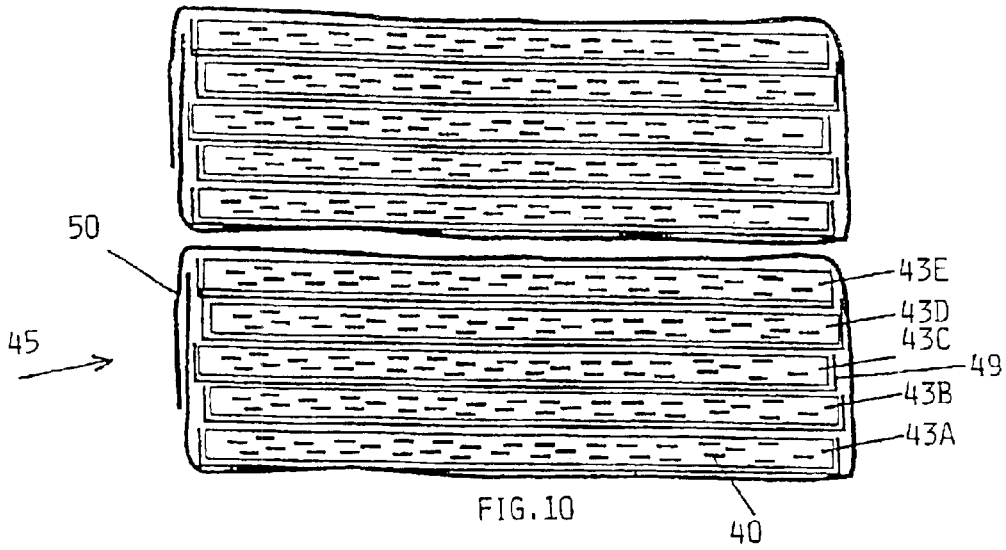

FIG. 10 in cross section and much enlarged shows a favourable composition of conductors for providing the winding in an apparatus according to the invention. A very suitable form of conductor elements with an incorporated superconducting material is based on elements 43A,B,C,D,E in FIG. 10. These conductor elements are clearly ribbon-shaped with a quite small thickness compared to the width. Such conductor elements each comprises a high number of thin superconducting ribbons or filaments 40 as shown for conductor element 43A, whereby each conductor element has typical dimensions of 4×0,2 mm and can carry a couple of tens of amperes of alternating current. The material in each conductor element 43A–E is in addition to the superconducting filaments 40, substantially silver. Conductor elements 43A–E are electrically insulated from each other, for example by having a ceramic coating on the surface or by having thin, insulating foils interleaved between the conductor elements. Such a foil 49 is indicated in FIG. 10 for conductor element 43C. In FIG. 10 five of these conductor elements are assembled into a conductor group 45 with a common outer insulation 50. Such a conductor group then forms the turns in windings as previously described. The conductor group can comprise a variable number of conductor elements, since a number of elements equal to five as shown in the example of FIG. 10, obviously is not limiting. Typically the number of conductor elements may vary from two to eight depending of, inter alia, which voltage level is to be used for operating the induction apparatus.

Figure 11:
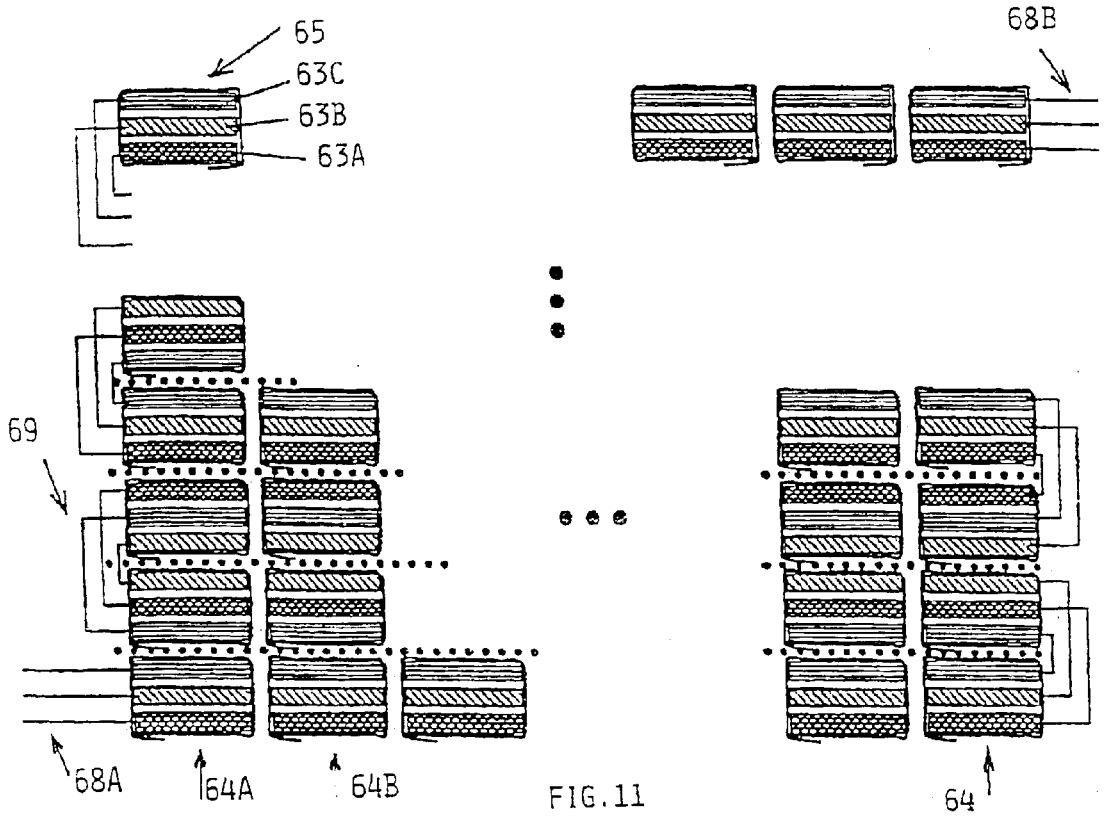
Figure 12:
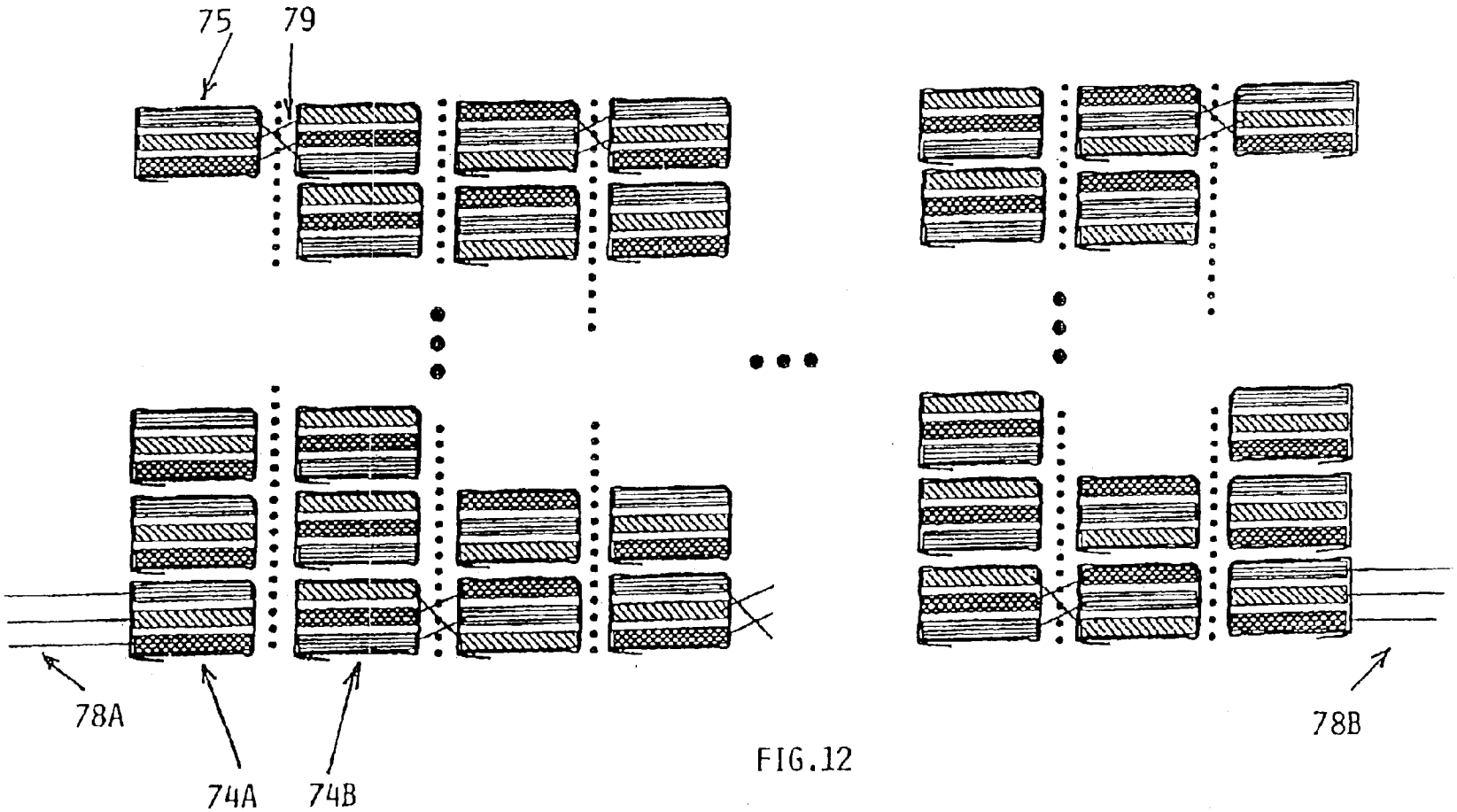

FIGS. 11 and 12 illustrate two different winding methods based on a conductor in the form of conductor groups of the same structure as conductor group 45 in FIG. 10, but having only three ribbon-shaped conductor elements. Thus, in FIG. 11 there is shown a conductor group 65 with three conductor elements 63A,63B and 63C. These are indicated each with its individual hatching. The complete winding in FIG. 11 is considered to be wound in layers according to the conventional manner, i.e. with an undermost (lowermost) winding layer wherein among others, the conductor groups 64,64A and 64B are incorporated. As seen from the hatching the three ribbon elements in the first layer of the winding, lie in the same mutual position in the conductor groups. In the subsequent and the following layers thereafter, the conductor groups are rotated or transposed from layer to layer as illustrated, whereby the electrical connection between the layers, as for example illustrated at 69, provides for an appropriate electrical coupling between the layers of the winding. The transposition referred to with respect to the conductor elements within each conductor group, results in an impedance being as similar as possible in the individual conductor elements, so that the current will have an equal distribution and the current capacity of the superconductors will be taken advantage of in the best way possible. An outer current connection to the winding as a whole is shown at 68A and 68B, respectively.

FIG. 12 is an illustration of the same kind as FIG. 11, with hatching for indicating the conductor elements being incorporated in a conductor group, whereby three conductor groups 74A,74B and 75 are specifically indicated in this figure. The arrangement here is based on socalled "pancake windings", i.e. several flat, package-like winding parts being placed side by side in the axial direction of the complete winding. Thus, conductor groups 74A and 74B as shown, constitute the first or innermost winding each in their pancake or package winding part. Each package part thereby has a substantially larger diameter than its axial dimension. Also in this winding embodiment it is required to have transposition, as shown at 79 for the connection between conductor group 75 and the neighbouring group in the adjacent package part or pancake. At 78A and 78B respectively, there are shown connections for applying current to this winding. It will be realized that there are many possibilities with respect to the structure of the conductor or the conductor group forming the individual turns of the winding and the arrangement of the winding as a whole, as this can be more or less subdivided or sectioned. Among other things it can be appropriate to provide for adaption of the winding for three-phase operation.

What is claimed is:

1. Apparatus for induction heating of billet-shaped blanks (10) of electrically well conductive and non-magnetic metal, in particular aluminium or copper, comprising a winding (1,21) adapted to surround the blank (10) completely or partially, to be supplied with electric alternating current (8) from a power supply, and to be cooled by means of a cooling system (5,22) at least during the heating of the blank (10), characterized in that the winding (1,21) has turns comprising superconducting material (40) and is surrounded by a thermally insulating chamber (3,33), that the cooling system (5,22) is adapted to maintain the winding at a temperature in the range of 30–90° K, and that the frequency of the alternating current (8) is adapted to be in a range of common mains frequencies.

2. Apparatus according to claim 1, characterized in that the cooling in the cooling system takes place with liquid nitrogen or helium gas being brought to circulate in cavities (5) or cooling channels adjacent to the winding (1) inside the thermally insulating chamber (3).

3. Apparatus according to claim 1, characterized in that a jacket (22) of well heat conducting, but electrically insulating material, being in thermal contact with the winding (21) and being cooled by means of a cooling unit (23) which is a part of the cooling circuit of the cooling system.

4. Apparatus according to claim 3, characterized in that the jacket (22) is located substantially radially inside the winding (21) and preferably constitutes a substantial supporting element for the winding (21).

5. Apparatus according to claim 3, characterized in that the jacket (22) is thermally connected to at least one rod-like cooling head (26A,B) penetrating a wall of the thermally insulated chamber (33), preferably with a cooling head (26A,B) at either end of the winding (21), and that the cooling unit (23) has fluid communication (23A,23B) with each cooling head.

6. Apparatus according to claim 1, characterized by means (11,12) adapted to at least partially extend the magnetic field resulting from the winding (21), more axially outwards at the ends of the winding (21).

7. Apparatus according to claim 6, characterized in that said means comprise elements (11,12) of ferromagnetic material located at the ends of the winding (21).

8. Apparatus according to claim 1, characterized in that the cooling system (5,22) is adapted to maintain the winding at a temperature in the range of 40–77° K.

9. Apparatus according to claim 1, characterized in that the superconducting material (40) in the windings (21,45) is incorporated in a ribbon-shaped conductor element (43A) having a substantially larger width than thickness. (FIG. 10).

10. Apparatus according to claim 9, characterized in that a number of ribbon-shaped conductor elements (43A–E, 63A–C) are assembled into a conductor group (45,65,75) being incorporated in the winding. (FIGS. 10, 11, 12).

11. Apparatus according to claim 10, characterized in that one or more conductor groups (45,75) is/are wound into a plurality of flat, package-like parts (24,A,B,C,44A,B,C,74A, B) having a substantially larger diameter than axial dimension, and that the position in the conductor group is transposed (79) between axially adjacent package-like winding parts. (FIG. 12).

12. Apparatus according to claim 11, characterized in that between the package-like winding parts (44A,B,C) there are provided rod-shaped or disc-shaped separating elements (48A,B,C) of thermally well conducting, but electrically insulating material. (FIG. 7).

13. Apparatus according to claim 10, characterized in that each ribbon-shaped conductor element (43B) is electrically insulated (49) in relation to the adjacent conductor elements (43A,43C), and that each conductor group (45,65,75) is electrically insulated (50). (FIG. 10).

* * * * *